United States Patent [19]

Kinsey et al.

[11] 4,135,452

[45] Jan. 23, 1979

[54] TIME DELAY COMPUTER USING FUZE DOPPLER FOR AIR-TO-AIR MISSILES

[75] Inventors: Lloyd E. Kinsey; Gregory C. Roush, both of Ridgecrest, Calif.

[73] Assignee: The United States of America as represented by the Secretary of the Navy, Washington, D.C.

[21] Appl. No.: 868,157

[22] Filed: Jan. 9, 1978

[51] Int. Cl.[2] ..... F42C 13/04

[52] U.S. Cl. ..... 102/214; 102/215

[58] Field of Search ..... 102/214, 215; 343/7 PF

[56] References Cited

U.S. PATENT DOCUMENTS

| | | | |
|---|---|---|---|
| 3,670,652 | 6/1972 | Ziemba | 102/214 |
| 3,858,207 | 12/1974 | Macomber et al. | 102/214 |
| 3,906,503 | 9/1975 | Stephens | 102/214 |
| 3,908,190 | 9/1975 | Nathan et al. | 343/7 PF |
| 3,924,233 | 12/1975 | Nastronero et al. | 102/214 |
| 3,934,510 | 1/1976 | Dahl | 102/214 |
| 3,945,008 | 3/1976 | Schmucker | 102/214 |
| 3,965,470 | 6/1976 | Clinard et al. | 343/7 PF |
| 4,015,530 | 4/1977 | Dick | 102/215 |

*Primary Examiner*—Charles T. Jordan

*Attorney, Agent, or Firm*—R. S. Sciascia; W. Thom Skeer; T. R. Schulte

[57] ABSTRACT

Fuzing incorporating a doppler signal for establishing warhead fuzing time. More particularly, circuitry is provided in which the doppler is detected, integrated and used upon exceeding the level of a preset threshold device to enable two preset counters to effect fuzing only if their individual preset counts are achieved within a time established by their associated timers. A third, higher count, preset counter effects the fuzing if not earlier realized from one of the other counters, while a dropout detector responsive to the threshold device output effects the fuzing in cases where the threshold level is exceeded and then lost.

11 Claims, 1 Drawing Figure

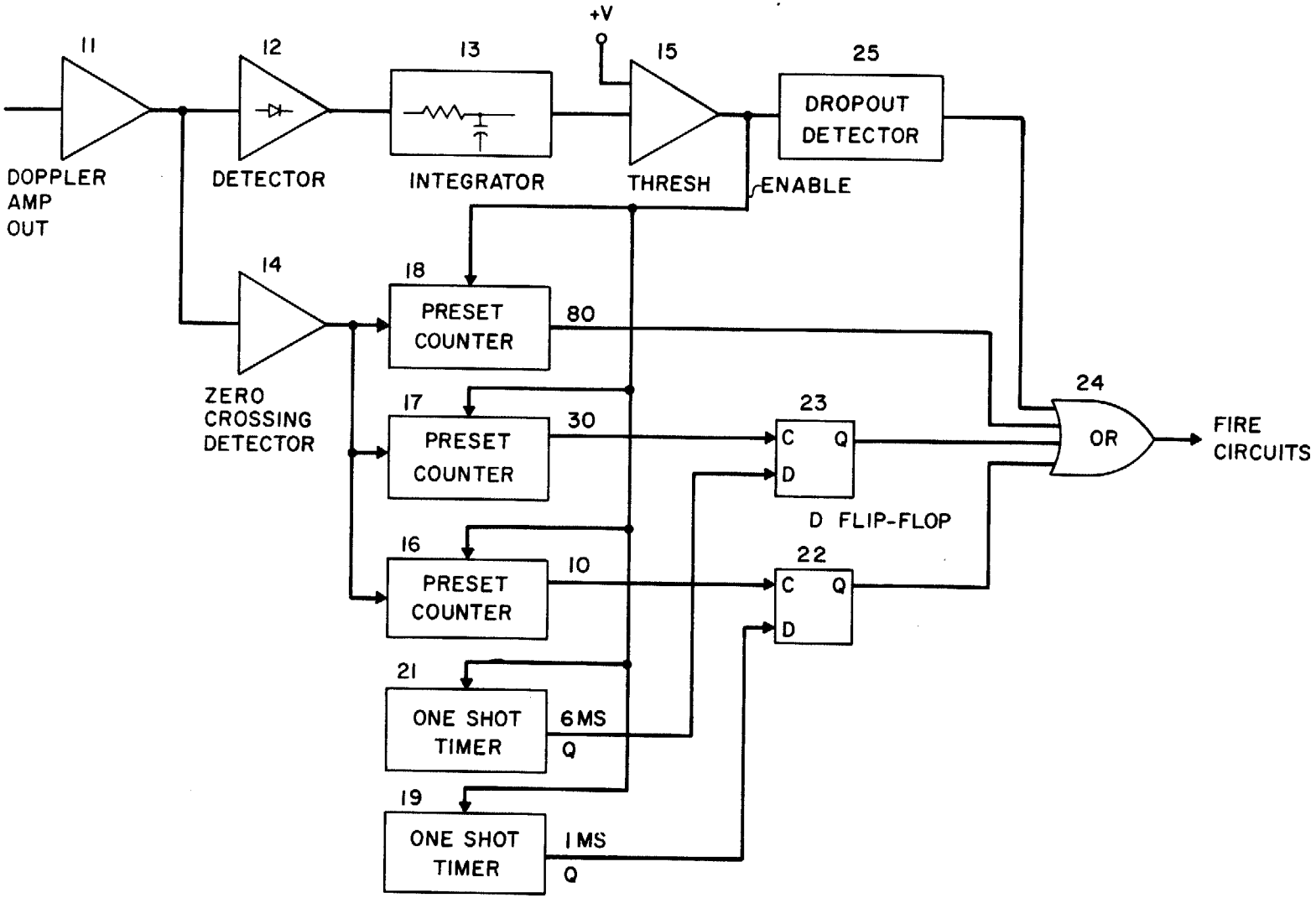
FIRE CIRCUITS
24
OR
25
DROPOUT DETECTOR
ENABLE
23
C
Q
D
D FLIP-FLOP
22
C
Q
D
15
THRESH
+V
13
INTEGRATOR
80
30
10
6MS
Q
1MS
Q
18
PRESET COUNTER
17
PRESET COUNTER
16
PRESET COUNTER
21
ONE SHOT TIMER
19
ONE SHOT TIMER
12
DETECTOR
14
ZERO CROSSING DETECTOR
11
DOPPLER AMP OUT

TIME DELAY COMPUTER USING FUZE DOPPLER FOR AIR-TO-AIR MISSILES

BACKGROUND OF THE INVENTION

1. Field of the Invention

This invention relates to the field of electronics. More particularly, this invention relates to electronic triggering devices. In still greater particularly, this invention relates to electronic fuze actuating systems. By way of further characterization, but not by way of limitation thereto, the invention uses a recovered doppler signal received on board a missile to establish the fuzing time of its warhead.

2. Description of the Prior Art

Fuzing time of a missile warhead is important in maximizing the effectiveness of the warhead. Because direct target contact is not always achieved, the warhead must be detonated at the next best time, that is, when the warhead is closest to the target. Since, for example, in air-to-air situations, both the missile and the target are moving at relatively high velocities with respect to one another, it is difficult to determine the optimum warhead fuzing time.

In some guided projectiles, information on relative velocities of the missile and the target is available from the guidance system by utilizing a transmitter on the launching medium. However, in a system where closing velocities are not directly available, such as a passive air-to-air missile system, it is much more difficult to accurately determine fuzing time. Additionally, since the missile guidance system itself is not used, target information must be obtained solely from the fuzing system. Since relatively short-range transmitters are used in fuzing systems, there is a relatively short time frame during which the fuzing determination must be made.

The criticality of fuzing time is especially important in a system in which the warhead is of a directional rather than a fragmentation type. Directional warheads are utilized because their energy is concentrated in a specific direction. Therefore, more accurate fuzing times are required because the effective kill area of the warhead is diminished.

Prior art fuzing systems, using recovered doppler signals, detonate the warhead once a predetermined doppler frequency has been reached. Such a device is shown in U.S. Pat. No. 3,945,008 issued to Georg Schmucker on Mar. 16, 1976. While satisfactory for its intended purpose, this system causes automatic triggering of the fuze when the doppler frequency signals reach predetermined minimum amplitudes. There is, therefore, no provisions made for changes in closing velocity and therefore accuracy may be affected. Devices using counters to effect a time delay have also been employed. One such device utilizes preset counters driven by a local oscillator device and a remote source at the point of firing. This device is shown in U.S. Pat. No. 3,670,652 issued to Richard T. Ziemba on June 20, 1972. While satisfactory for its intended purpose for surface-to-surface projectiles where one can vary the counter according to observed hit-miss data, such a fuzing device would be less satisfactory for use with swiftly moving targets and no opportunity to observe hit-miss. Other fuzing devices using counting techniques employ frequency or amplitude comparators to compare sucessive wavetrains. These devices require constant velocities and constant transmitted wave frequencies or amplitudes to function effectively. As such they are susceptible to jamming and evasive maneuvers by a moving target. Devices using multiple band-pass filters have also been used for warhead fuzing. While all of the above are satisfactory for their intended purposes a device utilizing less circuitry and having greater accuracy and sensitivity to evasive tactics by the target was needed.

SUMMARY OF THE INVENTION

The present invention provides a fuze which can be utilized in a system in which relative projectile and target velocities are not directly available. The closing velocity is available indirectly from the recovered fuze doppler signal and the invention uses this recovered fuze doppler to determine optimum fuzing time.

Specifically, the doppler signal is detected and integrated with the resultant signal being compared to a threshold voltage. Upon exceeding this threshold, the counting and timing circuitry is enabled. The number of doppler waves are counted and, upon reaching a predetermined number a pulse is initiated. The timers, enabled at the same time as the counters, trigger a pulse for a predetermined period of time. Circuitry is provided so that, if a counter reaches its predetermined count before its associated timer ends its predetermined time, a pulse is initiated which detonates the warhead. If the signal is not of a high enough frequency to cause warhead detonation by the previous counter/timer method, then a separate counter, not associated with a timer, initiates a pulse upon reaching its predetermined count. Another back-up device initiates firing if the threshold voltage is lost after having enabled the counting and timing circuitry.

BRIEF DESCRIPTION OF THE DRAWING

FIG. 1 is a block diagram of the preferred embodiment of the invention.

DESCRIPTION OF THE PREFERRED EMBODIMENT

Referring to FIG. 1, after the recovered signal has been demodulated by receiver circuitry (not shown), it is fed to doppler amplifier 11. The signal is then fed to detector 12 and integrator 13 where the signal is converted from an AC to DC mode. The signal from doppler amplifier 11 is also fed to zero crossing detector 14 where the analog doppler signal is converted to a square wave configuration.

From detector 12 and integrator 13 the doppler signal is fed to threshold amplifier 15. Threshold amplifier 15 is loaded by a voltage source (+V). This voltage source (+V) is set such that the doppler signal must reach a predetermined amplitude in order that V is exceeded. When a signal is outputted from threshold amplifier 15, counters 16, 17, 18, one-shot timers 19 and 21, and drop-out detector 25 are all enabled.

Upon being enabled, the preset counters 16, 17, and 18 begin to count the square wave outputted by zero crossing detector 14. Counters 16 and 17 have their output connected to their Respective D flip-flop circuits 22 and 23. The enabling signal from threshold amplifier 15 also starts one-shot timers 19 and 21. Timers 19 and 21 also have their outputs connected to their respective D flip-flop circuits 22 and 23. D Flip-flop circuits 22 and 23, preset counter 18, and drop-out detector 25 have their outputs connected to OR gate 24.

OR gate 24 has its output connected to the firing circuitry (not shown).

MODE OF OPERATION

Referring to FIG. 1, when the counters 16, 17, and 18 are enabled by the signal from threshold 15 they begin to count the square wave signals fed by zero crossing detector 14. Upon reaching a predetermined wave count, a signal is sent from each counter to either an associated D flip-flop circuit 22 and 23 or, in the case of counter 18, directly to OR gate 24. The signals from counters 16 and 17 are sent to D flip-flop circuits 22 and 23 respectively. In the case of counter 18 the output signal is fed directly to OR circuit 24, triggering a signal to the firing circuit. When the timers 19 and 21 are enabled by a signal from threshold 15 they emit a signal for a predetermined amount of time. The signal from timers 19 and 21, fed to their respective D flip-flop circuits 22 and 23, latch D flip-flop circuits 22 and 23 on if their respective counters 16 and 17 output the predetermined count signal during the period when the timer is emitting a signal. The output signal from D flip-flop 22 and 23 is fed to OR circuit 24.

In the illustrated embodiment, the result of the above operations is as follows. If counter 16 counts ten square wave pulses before one-shot timer 19 counts one millisecond and ends an enabling pulse to D flip-flop circuit 22, then a pulse would be initiated to OR gate 24 which in turn would initiate a pulse to the fire circuits (not shown). Similarly, if preset counter 17 counts thirty square wave pulses thereby initiating a pulse to D flip-flop circuit 23 before one-shot timer 21 counts six milliseconds and ends an enabling pulse to D flip-flop circuit 23, then D flip-flop circuit 23 initiates a pulse to OR gate 24 thereby triggering the fire circuits (not shown). If both D flip-flops 22 and 23 are disabled by their respective timers 19 or 21 before being triggered by associated counters 16 or 17, then counter 18 upon counting eighty square wave pulses, initiates its pulse directly to OR gate 24 thereby activating the firing circuits (not shown).

The invention is provided with a further backup system in dropout detector 25. The function of dropout detector 25 is to trigger a signal to OR gate 24 if, having been enabled by threshold 15, the enabling signal is thereafter lost due to a drop in signal voltage below the +V level on threshold amplifier 15. Thus, OR gate 24, and the firing circuits (not shown), are activated if it is determined that the projectile is now moving away from the target.

The predetermined wave count and the predetermined time delay are selected by a computer to optimize warhead effectiveness. Specifically, a computer is programed with the following time delay function:

$$T = A/F_d$$

where T is the predetermined time delay, A is the predetermined wave count in cycles, and $F_d$ is the fuze doppler in units of hertz. The fuze doppler ($F_d$) is equal to $2F_0/C\ V_{mt} \cos \gamma$ where $F_0$ is the transmitter frequency, $V_{mt}$ is the closing velocity, $\gamma$ is the angle between the closing velocity vector and the transmitter beam, and C is the speed of light.

The computer is fed the time delay function and, by analytical simulation using various fuze doppler ($F_d$) values, a table is compiled giving kill probabilities as a function of T and A values. This table allows the selection of T and A values resulting in a fixed distance delay to optimize warhead effectiveness. Either a fixed time delay or a hyberbolic delay function which uses both distance and time delays may also be programmed into the computer and the results utilized with the present invention to optimize kill probability.

While particular forms of the invention have been described with respect to a particular embodiment thereof, it is not to be so limited as changes and modifications may be made therein which are within the full intended scope of the invention as defined by the appended claims.

What is claimed is:

1. An electronic device for detonating an explosive charge comprising:

signal means for providing a wave train which has been reflected from a target, converting means, electrically connected to said signal means, for altering said reflected wave train;

enabling means, electrically connected to said converting means, for transmitting a pulse when said wave train has reached a predetermined amplitude, reckoning means, electrically activated by said enabling means, for analyzing the frequency of said wave train; and triggering means, electrically connected to said reckoning means, for releasing an electrical pulse;

whereby said electrical pulse activates firing circuits.

2. An electronic device for detonating an explosive charge according to claim 1 wherein said converting means includes:

a doppler amplifier;

a detector amplifier, electrically connected to said doppler amplifier;

an integrator, electrically connected to said detector amplifier, which, when combined with said detector, changes said wave train from AC to DC; and a zero crossing detector, electrically connected to said doppler amplifier, for transforming said wave train to square pulses.

3. An electronic device for detonating an explosive charge according to claim 1 wherein said enabling means includes a threshold amplifier loaded by a predetermined voltage.

4. An electronic device for detonating an explosive charge according to claim 2 wherein the aforesaid enabling means includes a threshold amplifier, electrically connected to said integrator, said threshold amplifier loaded by a predetermined voltage.

5. An electronic device for detonating an explosive charge according to claim 1 wherein said reckoning means comprises:

counting means, electrically connected to said enabling means, for calculating a predetermined number of waves in said wave train thereby initiating a pulse to said triggering means;

timing means, electrically connected to said enabling means, for measuring a predetermined amount of time, thereby ending an enabling pulse to said triggering means; and secondary arming means, electrically connected to said enabling means, for providing a pulse signal to said triggering means.

6. An electronic device for detonating an explosive charge according to claim 5 wherein said counting means comprises a plurality of preset wave counters.

7. An electronic device for detonating an explosive charge according to claim 5 wherein said timing means comprises a plurality of one-shot timers.

8. An electronic device for detonating an explosive charge according to claim 5 wherein said secondary arming means comprises a drop-out detector.

9. An electronic device for detonating an explosive charge according to claim 4 wherein the aforesaid reckoning means comprises:

counting means, electrically connected to said threshold amplifier, for calculating a predetermined number of waves in said wave train, thereby initiating a pulse to the aforesaid triggering means, timing means, electrically connected to said threshold amplifier, for measuring a predetermined amount of time, thereby ending an enabling pulse to the aforesaid triggering means; and secondary arming means, electrically connected to said threshold amplifier, for providing a pulse signal to the aforesaid triggering means.

10. An electronic device for detonating an explosive charge according to claim 1 wherein said triggering means comprises:

at least one OR gate; and a plurality of D flip-flop circuits, electrically connected to said OR gate.

11. An electronic device for detonating an explosive charge according to claim 9 wherein the aforesaid triggering means includes:

at least one OR gate; and a plurality of D flip-flop circuits, each having two inputs and one output, one of said inputs being electrically connected to said counting means, the other of said inputs being electrically connected to said timing means, and said output being connected to said OR gate.

* * * * *